US009493886B2

(12) United States Patent
Allardyce et al.

(10) Patent No.: US 9,493,886 B2
(45) Date of Patent: Nov. 15, 2016

(54) LOW INTERNAL STRESS COPPER ELECTROPLATING METHOD

(75) Inventors: George R. Allardyce, Hinckley (GB); Gary Hamm, Billerica, MA (US); Narsmoul Karaya, Dorchester, MA (US)

(73) Assignee: Rohm and Haas Electronic Materials LLC

( * ) Notice: Subject to any disclaimer, the term of this patent is extended or adjusted under 35 U.S.C. 154(b) by 292 days.

(21) Appl. No.: 13/607,737

(22) Filed: Sep. 9, 2012

(65) Prior Publication Data

US 2013/0240368 A1 Sep. 19, 2013

Related U.S. Application Data

(60) Provisional application No. 61/573,652, filed on Sep. 9, 2011.

(51) Int. Cl.
*C25D 21/12* (2006.01)
*C25D 3/38* (2006.01)
*C25D 5/54* (2006.01)

(52) U.S. Cl.
CPC .. *C25D 5/54* (2013.01); *C25D 3/38* (2013.01)

(58) Field of Classification Search
CPC ..... C25D 3/38; C25D 5/00
USPC ..... 205/291, 296, 83
See application file for complete search history.

(56) References Cited

U.S. PATENT DOCUMENTS

| | | | | |
|---|---|---|---|---|
| 3,051,634 | A * | 8/1962 | Strauss | C25D 3/38 205/298 |
| 3,956,120 | A | 5/1976 | Kardos et al. | |
| 4,181,582 | A | 1/1980 | Dahms | |
| 6,071,398 | A * | 6/2000 | Martin et al. | 205/103 |
| 6,911,068 | B2 | 6/2005 | Cobley et al. | |
| 7,804,022 | B2 | 9/2010 | De Ceuster | |
| 7,883,343 | B1 | 2/2011 | Mulligan et al. | |
| 8,192,607 | B2 | 6/2012 | Konigshofen et al. | |
| 2003/0070934 | A1 * | 4/2003 | Cobley et al. | 205/263 |
| 2003/0102226 | A1 | 6/2003 | Gabe et al. | |
| 2004/0074775 | A1 * | 4/2004 | Herdman et al. | 205/103 |
| 2004/0104117 | A1 | 6/2004 | Yang et al. | |
| 2004/0206631 | A1 * | 10/2004 | Cobley | C25D 3/02 205/291 |
| 2004/0222104 | A1 | 11/2004 | Wang et al. | |
| 2006/0012044 | A1 * | 1/2006 | Knop et al. | 257/750 |
| 2006/0049058 | A1 | 3/2006 | van Wijngaarden et al. | |
| 2007/0158204 | A1 | 7/2007 | Taylor et al. | |

(Continued)

FOREIGN PATENT DOCUMENTS

| | | |
|---|---|---|
| EP | 0419845 | 4/1991 |
| WO | 2011054036 | 5/2011 |

OTHER PUBLICATIONS

Kanani,N., "Electroplating. Basic principles, processes and practice", Elsevier, 2007, pp. 58-71.

(Continued)

*Primary Examiner* — Edna Wong

(74) *Attorney, Agent, or Firm* — John J. Piskorski

(57) ABSTRACT

Copper electroplating methods provide low internal stress copper deposits. Concentrations of accelerators in the copper electroplating bath vary as a function of the plating current density and the low internal stress copper deposit is observed as a matt copper deposit.

6 Claims, 11 Drawing Sheets
(7 of 11 Drawing Sheet(s) Filed in Color)

(56) References Cited

U.S. PATENT DOCUMENTS

| | | | |
|---|---|---|---|
| 2007/0224444 | A1 | 9/2007 | Sakuyama |
| 2008/0302668 | A1 | 12/2008 | Konigshofen et al. |
| 2011/0100826 | A1 | 5/2011 | Leavy |
| 2011/0233065 | A1 | 9/2011 | Koenigshofen |

OTHER PUBLICATIONS

Oniciu, L., "Some fundamental aspects of levelling and brightening in metal electrodeposition", Journal of Applied Electrochemistry, 1991, pp. 565-574, vol. 21.

Schlesinger, M., "Modem Electroplating", 2007, pp. 63-73.

Leaman, Frank H., "A new frontier for deposit stress measurements", http://www.specialtytest.com/new_frontier1.shtml, Jan. 24, 2013.

Stein, B., "A practical guide to understanding, measuring and controlling stress in electroformed metals", AESF Electrforming Symposium, Mar. 27-29, 1996.

Moffat et al, "Accelerator aging effects during copper electrodeposition", Electrochemical and Solid-State Letters, 2003, pp. C59-C62, vol. 6, No. 4.

Brongersma, et al, "Two-step room temperature grain growth in electroplated copper", Journal of Applied Physics, Oct. 1, 1999, pp. 3642-3645, vol. 86, No. 7.

Kim, et al, "Stress behavior of electrodeposited copper films as mechanical supporters for light emitting diodes", Electrochimica Acta, 2007, pp. 5258-5265, vol. 52.

Yin, et al., "The kinetics and mechanism of room-temperature microstructural evolution in electroplated copper foils", Scripta Materials, 2008, pp. 65-68, vol. 58.

Deposit Stress Analyzer brochure from Specialty Testing & Development Co., in Jacobus, Pennsylvania.

European Search Report corresponds with Europe Application No. 12 18 3586.

China Search Reports corresponds with China Application No. 201210461899.8.

Singapore Search Report corresponds with Singapore Application No. 201206694.0.

* cited by examiner

As plated – Stress 160 psi

After deposit ageing –Stress 450 psi

As plated – Stress 0 psi

After deposit ageing – Stress 30 psi

LOW INTERNAL STRESS COPPER ELECTROPLATING METHOD

This application claims the benefit of priority under 35 U.S.C. §119(e) to U.S. Provisional Application No. 61/573,652, filed Sep. 9, 2011, the entire contents of which application are incorporated herein by reference.

The present invention is directed to a low internal stress copper electroplating method. More specifically, the present invention is directed to a low internal stress copper electroplating method where copper is electroplated from an electroplating composition which includes sulfur containing plating accelerator compounds at concentrations dependent on the operational current density to provide a low internal stress copper deposit.

Internal or intrinsic stress of electrodeposited metals is a well known phenomenon caused by imperfections in the electroplated crystal structure. After the electroplating operation such imperfections seek to self correct and this induces a force on the deposit to contract (tensile strength) or expand (compressive stress). This stress and its relief can be problematic. For example, when electroplating is predominantly on one side of a substrate it can lead to curling, bowing and warping of the substrate depending on the flexibility of the substrate and the magnitude of the stress. Stress can lead to poor adhesion of the deposit to the substrate resulting in blistering, peeling or cracking. This is especially the case for difficult to adhere substrates, such as semiconductor wafers or those with relatively smooth surface topography. In general, the magnitude of stress is proportional to deposit thickness thus it can be problematic where thicker deposits are required or indeed may limit the achievable deposit thickness.

Most metals including copper deposited from an acid electroplating process exhibits internal stress. Commercial copper acid electroplating processes utilize various organic additives which beneficially modify the electroplating process and deposit characteristics. It is also known that deposits from such electroplating baths may undergo room temperature self annealing. Transformation of the grain structure during such self annealing concurrently results in a change in the deposit stress, often increasing it. Not only is internal stress problematic in itself but is typically subject to change on aging as the deposit self anneals with time resulting in unpredictability.

The fundamental mechanism of alleviating intrinsic stress in copper electroplating is not well understood. Parameters, such as reducing deposit thickness, lowering current density, i.e., plating speed, substrate type, seed layer or under plate selection, electroplating bath composition, such as anion type, additives, impurities and contaminants are known to affect deposit stress. Such empirical means of reducing stress have been employed though typically are not consistent or compromise the efficiency of the electroplating process. Accordingly, there is still a need for a copper electroplating process which alleviates internal stress in copper deposits.

A method includes contacting a substrate with a composition comprising one or more sources of copper ions, one or more suppressors and one or more accelerators in sufficient amounts to provide a copper deposit of matt appearance; and applying a current to the substrate to achieve a current density at or below Matt CDmax throughout the substrate to deposit the copper of matt appearance on the substrate.

The copper deposit is of low internal stress with relatively large grain structure. In addition, the internal stress and grain structure do not substantially change as the deposit ages, thus increasing predictability of the performance of the deposit. The methods may be used to deposit copper on relatively thin substrates without the concern that the substrate may bow, curl or warp. Adhesion is also improved reducing the probability of blistering, peeling or cracking of the deposit.

BRIEF DESCRIPTION OF THE SEVERAL VIEWS OF THE DRAWINGS

The file of this patent contains at least one drawing executed in color. Copied of this patent with color drawing (s) will be provided by the Patent Office upon request and payment of the necessary fee.

Figure 1A:
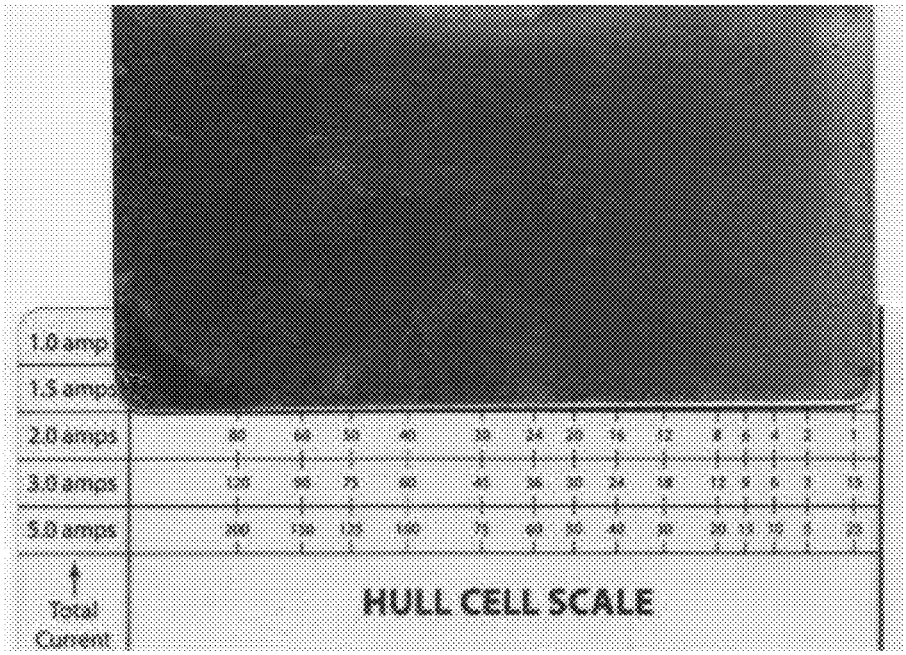
Figure 1a PRIOR ART
FIG. 1*a* is a photograph of a copper electroplated brass hull cell panel electroplated at a total current of 2 amperes for 10 minutes with a conventional copper electroplating bath without 3-mercapto-1-propane sulfonate to form a bright copper deposit.

As used throughout this specification, the terms "depositing", "plating" and "electroplating" are used interchangeably. The terms "composition" and "bath" are used interchangeably. The indefinite articles "a" and "an" are intended to include both the singular and the plural. The term "matt" means lusterless or lacking gloss. The term "matt current density maximum" means the highest current density for a given concentration of a sulfur containing plating accelerator compound in a copper plating bath at which copper may be plated to provide a matt deposit of low internal stress.

The following abbreviations have the following meanings unless the context clearly indicates otherwise: "MattCDmax"=matt current density maximum; ° C.=degrees Celsius; g=grams; ml=milliliter; L=liter; ppm=parts per million; ppb=parts per billion; A=amperes=Amps; DC=direct current; dm=decimeter; mm=millimeter; μm=micrometers; nm=nanometers; SEM=scanning electron micrograph; ASF or asf=amperes/square foot=0.108 A/dm$^2$; ASD=A/dm$^2$ 2.54 cm=1 inch; psi=pounds per square inch=0.06805 atmospheres; 1 atmosphere=1.01325×10$^6$ dynes/square centimeter; FIB=focused ion beam milling; and RFID=radio frequency identification.

All percentages and ratios are by weight unless otherwise indicated. All ranges are inclusive and combinable in any order except where it is clear that such numerical ranges are constrained to add up to 100%.

Copper is electroplated from copper compositions which include one or more sources of copper ions, one or more accelerators at concentrations such that the copper deposits have matt appearance and low internal stress and minimal change in stress as the copper deposit ages. The concentrations of the accelerators which provide the matt copper deposit of low internal stress are dependent on the current density. Therefore, the concentration may be tailored for a given current density. The maximum current density at which a matt deposit of low internal stress copper may be deposited for a given accelerator is the MattCDmax. The low internal stress copper deposits have a matt appearance with a relatively large as deposited grain size, typically of 2 microns or more. In addition to the one or more accelerators, the copper compositions include one or more suppressor compounds and a source of chloride ions.

Accelerators are compounds which in combination with one or more suppressors lead to an increase in plating rate at a given plating potential. The accelerators are typically sulfur containing organic compounds. The type of accelerators which may be used, in general, is not limited as long as the accelerator is used at concentrations and at current densities which provide copper deposits of matt appearance and with low internal stress. Accelerators include, but are not limited to, 3-mercapto-1-propane sulfonic acid, ethylenedithiodipropyl sulfonic acid, bis-(ω-sulfobutyl)-disulfide, methyl-(ω-sulfopropyl)-disulfide, N,N-dimethyldithiocarbamic acid (3-sulfopropyl) ester, (O-ethyldithiocarbonato)-S-(3-sulfopropyl)-ester, 3-[(amino-iminomethyl)-thiol]-1-propanesulfonic acid, 3-(2-benzylthiazolylthio)-1-propanesulfonic acid, bis-(sulfopropyl)-disulfide and alkali metal salts thereof. Preferably, the accelerator is chosen from 3-mercapto-1-propane sulfonic acid and its alkali metal salts.

In general, such accelerators may be included in amounts of 1 ppm and greater. Preferably such accelerators may be included in copper electroplating baths in amounts of 2 ppm and greater, more preferably from 3 ppm to 500 ppm. However, the amount of accelerator is determined by the current density and may vary from the ranges described.

Methods of correlating a concentration of accelerator to a maximum current density or to achieve matt low internal stress copper deposits are not limited. One method of determining the maximum current density to the minimum accelerator concentration involves using conventional Hull Cell, Hull Cell test panels and Hull Cell rulers typically calibrated in units of ASD or ASF. The Hull Cell is a well established method used to semi-quantitatively determine the deposition characteristics of an electroplating bath. It simulates the operation of an electroplating bath on lab scale and allows for optimization of current density range and additive concentration. The Hull Cell is a trapezoidal container that holds 250-300 ml volume of solution. This shape enables the test panel to be positioned at an angle to the anode such that anode to cathode (Hull Cell panel) varies along the length of the panel. As a result, the deposit is plated at different current densities along the length of the panel. The current density along the panel can be measured with a Hull Cell ruler.

A copper electroplating solution including a known concentration of one or more accelerators is placed in a Hull Cell. A conventional Hull Cell test panel of polished brass or other appropriate metal is connected to the negative (cathodic) terminal of a rectifier and the positive terminal is connected to an anode, such as copper metal or an inert, insoluble conductive material may also be used. A given current is then applied by the rectifier for a given time period, such as 5-20 minutes, to electroplate copper onto the test panel. In general, the total applied current from the rectifier typically ranges from 0.5 Amps to 5 Amps depending on the current density range to be examined. After the plating period the electroplated test panel is removed from the Hull Cell, rinsed and dried. A Hull Cell ruler is superimposed on the panel and the current density transition point from matt to bright deposit is determined. This transition point is the MattCDmax or the maximum current density at which the accelerator at the given concentration provides a Matt copper deposit of low internal stress. Current densities below the MattCDmax with the given accelerator concentration also produce low internal stress deposits. The concentration of the accelerator at the MattCDmax is the minimum concentration which provides a matt low internal stress copper deposit at that particular current density. This method may be repeated with varying accelerator concentrations to determine the MattCDmax for each accelerator concentration. The MattCDmax of combinations of two or more accelerators may also be determined.

Once the MattCDmax for concentrations of one or more accelerators has been determined a copper electroplating bath may be made up with one or more of the accelerators at that concentration and used to electroplate copper on a substrate at the MattCDmax or lower to achieve a low internal stress copper deposit. Since the MattCDmax concentration of the one or more accelerators is the minimum accelerator concentration, optionally, the concentration may be increased to above the MattCDmax concentration and still achieve a low internal stress copper deposit.

Electroplating is done by DC plating. As described above, the concentration of the accelerators in the copper electroplating compositions is dependent on the operational current density. In general, current density ranges from 0.5-50 ASD dependent on the application. Electroplating is done at temperature ranges from 15° C. to 80° C. or such as from room temperature to 60° C. or such as from 25° C. to 40° C.

Sources of copper ions include, but are not limited to, one or more of copper sulfates and copper alkane sulfonates. Typically copper sulfate and copper methane sulfonate are used. More typically copper sulfate is used as the source of copper ions. Copper compounds useful in the present invention are generally water-soluble and are commercially available or may be prepared by methods known in the literature. Copper compounds are included in the electroplating baths in amounts of 20 g/L to 300 g/L.

In addition to one or more sources of copper ions and one or more accelerators, the copper electroplating compositions also include one or more suppressors. Suppressors include, but are not limited to, polyoxyalkylene glycol, carboxymethylcellulose, nonylphenolpolyglycol ether, octandiolbis-(polyalkylene glycolether), octanolpolyalkylene glycolether, oleic acidpolyglycol ester, polyethylenepropylene glycol, polyethylene glycol, polyethylene glycoldimethylether, polyoxypropylene glycol, polypropylene glycol, polyvinylalcohol, stearic acidpolyglycol ester and stearyl alcoholpolyglycol ether. Such suppressors are included in conventional amounts. Typically they are included in the electroplating baths in amounts of 0.1 g/L to 10 g/L.

One or more optional additives may also be included in the electroplating composition. Such additives include, but are not limited to, levelers, surfactants, buffering agents, pH adjustors, sources of halide ions, organic and inorganic acids, chelating agents and complexing agents. Such additives are well known in the art and may be used in conventional amounts.

Levelers that may be used include, but are not limited to, alkylated polyalkyleneimines and organic sulfo sulfonates. Examples of such compounds are 1-(2-hydroxyethyl)-2-imidazolidinethione (HIT), 4-mercaptopyridine, 2-mercaptothiazoline, ethylene thiourea, thiourea and alkylated polyalkyleneimine. Such compounds are disclosed in U.S. Pat. No. 4,376,685, U.S. Pat. No. 4,555,315, and U.S. Pat. No. 3,770,598. Such levelers may be included in conventional amounts. Typically they are included in amounts of 1 ppb to 1 g/L.

Conventional nonionic, anionic, cationic and amphoteric surfactants may be included in the electroplating baths. Typically the surfactants are nonionic. Examples of nonionic surfactants are alkyl phenoxy polyethoxyethanols, nonionic surfactants which include multiple oxyethylene, such as polyoxyethylene polymers having from as many as 20 to 150 repeating units. Such compounds also may perform as suppressors. Further examples are block copolymers of polyoxyethylene and polyoxypropylene. Surfactants are included in conventional amounts. Typically they are included in the electroplating baths in amounts of 0.05 g/l to 15 g/L.

Typically sulfuric acid is included in the copper electroplating compositions. They are included in conventional amounts, such as from 5 g/L to 350 g/L.

Halogen ions include chloride, fluoride, and bromide. Such halides are typically added into the bath as a water soluble salt or acid. Chloride is typically used and is introduced into the bath as hydrochloric acid. Halogens may be included in the baths in conventional amounts, such as from 20 ppm to 500 ppm.

The electroplating baths are typically acidic. The pH range may be from less than 1 to less than 7, or such as from less than 1 to 5 or such as from less than 1 to 3.

Typically the methods are used to plate copper on relatively thin substrates or on sides of substrates where bowing, curling or warping are problems or on difficult to adhere to substrates where blistering, peeling or cracking of the deposit are common. For example, the methods may be used in the manufacture of printed circuit and wiring boards, such as flexible circuit boards, flexible circuit antennas, RFID tags, electrolytic foil, semiconductor wafers for photovoltaic devices and solar cells, including interdigitated rear contact solar cells. In general the methods are used to plate copper at thickness ranges of 1 μm and greater or such as from 1 μm to 5 mm or such as from 5 μm to 1 mm. When copper is used as the principle conductor in the formation of contacts for solar cells, the copper is plated to thickness ranges of 1 μm to 60 μm or such as from 5 μm to 50 μm.

The following examples are provided to illustrate the invention, but are not intended to limit the scope of the invention.

EXAMPLE 1

Four aqueous acid copper plating baths having the components and amounts were prepared as shown in the table below.

TABLE

| Component | Amount-Bath 1 | Amount-Bath 2 | Amount-Bath 3 | Amount-Bath 4 |
|---|---|---|---|---|
| Copper sulfate pentahydrate | 100 g/L | 100 g/L | 100 g/L | 100 g/L |
| Sulfuric acid (concentrated) | 200 g/L | 200 g/L | 200 g/L | 200 g/L |
| Chloride | 100 ppm | 100 ppm | 100 ppm | 100 ppm |
| 3-mercapto-1-propane sulfonic acid, sodium salt | 0 | 1 ppm | 3 ppm | 5 ppm |
| Bis-(Sodium sulfopropyl)-disulfide | 4 ppm | 4 ppm | 4 ppm | 4 ppm |
| Polyoxy-alkylene glycol[1] | 0.9 g/L | 0.9 g/L | 0.9 g/L | 0.9 g/L |
| Polyethylene glycol[2] | 1.1 g/L | 1.1 g/L | 1.1 g/L | 1.1 g/L |

[1]PolyMax ™ PA-66/LC (available from Heritage plastics, Inc. Picayune, MS)
[2]PEG 12000

Each bath was placed in a conventional Hull Cell equipped with air bubbling at the test panel (cathode) area. The anode was copper metal. The test coupons were conventional polished brass Hull Cell panels. Each Hull Cell panel was cleaned to a water break free surface then transferred to a Hull Cell containing one of the four copper plating baths. The panel and copper anode were connected to a rectifier such that the panel, copper plating bath and anode formed an electric circuit. A total current density of 2

Amps was applied to each panel. Each panel was plated for 10 minutes at a bath temperature of 30° C.

After plating each copper plated panel was removed from the Hull Cell with water and dried. A conventional Hull Cell ruler was placed over each copper plated panel as shown in FIGS. 1*a-d*. The Hull Cell ruler was calibrated in ASF. The panel plated with copper from Bath 1 which excluded the accelerator 3-mercapto-1-propane sulfonate, sodium salt was bright in appearance along its entire length as shown in FIG. 1*a*.

Figure 1B:
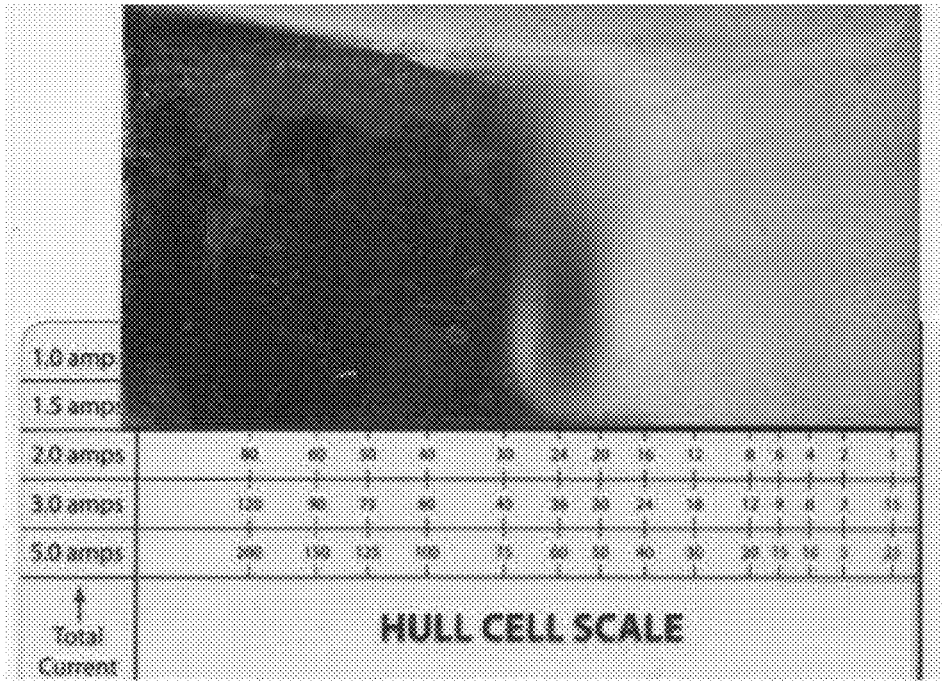
FIG. 1*b* is a photograph of a copper electroplated brass hull cell panel electroplated at a total current of 2 amperes where the copper electroplating bath included 3-mercapto-1-propane sulfonate, sodium salt at a concentration of 1 ppm to form a matt copper deposit region extending from lower to higher current density.
Figure 1C:
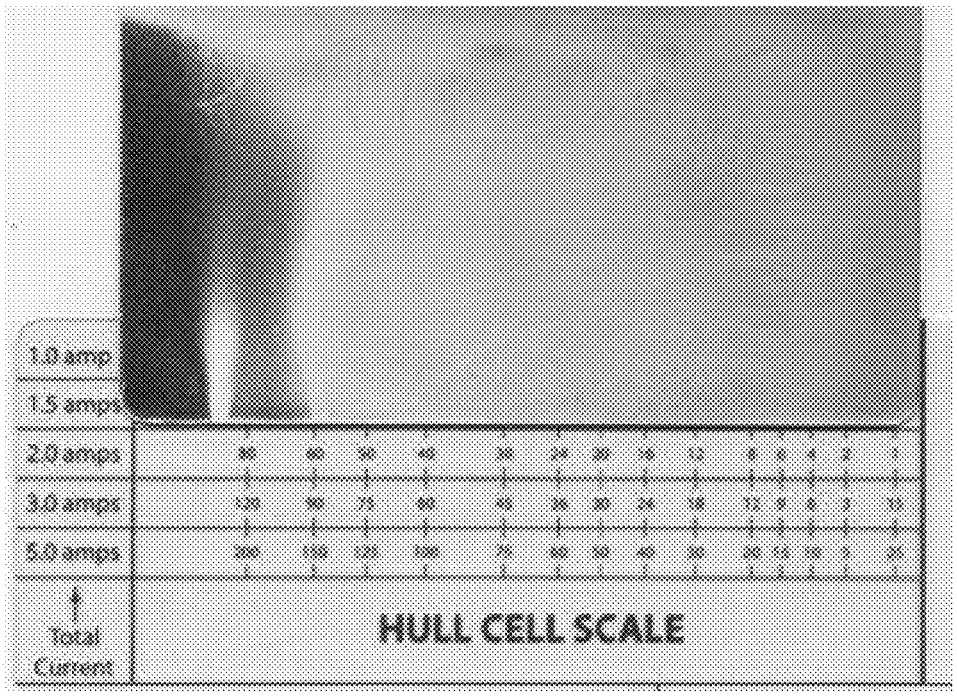
FIG. 1*c* is a photograph of a matt copper electroplated brass hull cell panel electroplated at 2 amperes for 10 minutes where the copper electroplating bath included 3-mercapto-1-propane sulfonate at a concentration of 3 ppm to form a matt copper deposit region extending from lower to higher current density.
Figure 1D:
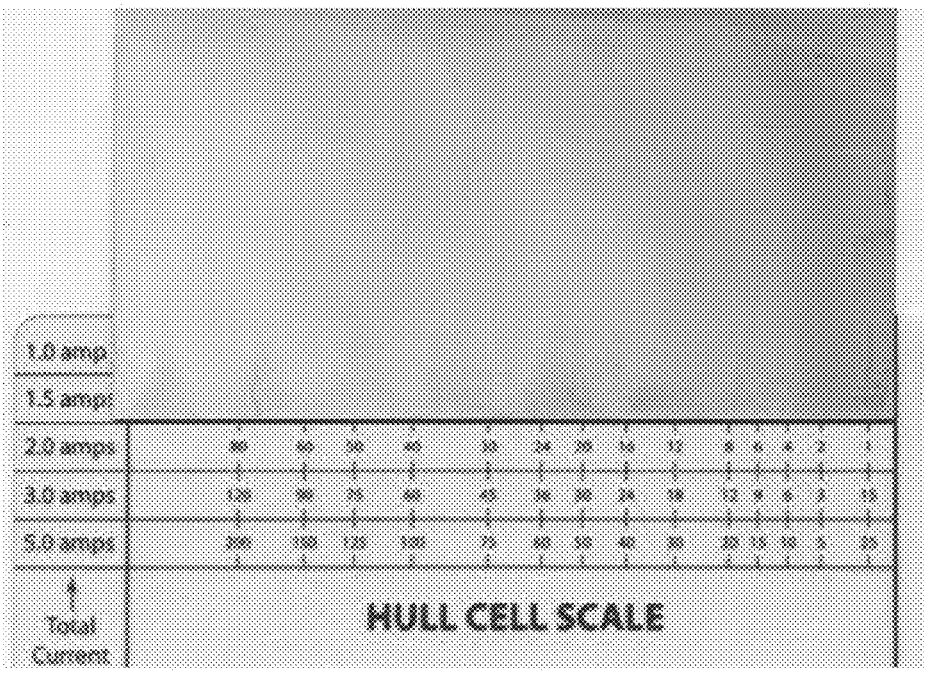
FIG. 1*d* is a photograph of a copper electroplated brass hull cell panel electroplated at 2 amperes for 10 minutes where the copper electroplating bath included 3-mercapto-1-propane sulfonate at a concentration of 5 ppm to form a matt copper deposit over the full current density range.

In contrast, the panels which were plated with copper baths which included 3-mercapto-1-propane sulfonate, sodium salt had matt copper deposit regions extending from lower to higher current density. It was also seen that the extent of the matt region increased in proportion to the concentration of 3-mercapto-1-propane sulfonate in the test bath. The panel plated with copper Bath 2 which had 3-mercapto-1-propane sulfonate, sodium salt at a concentration of 1 ppm had a matt deposit up to a current density of 20 ASF ($MattCD_{max}$) after which the copper deposit became bright in appearance as shown in FIG. 1*b*. The panel plated in Bath 3 where the 3-mercapto-1-propane sulfonate, sodium salt had a concentration of 3 ppm had a matt deposit up to 60 ASF ($MattCD_{max}$) after which the copper deposit became bright as shown in FIG. 1*c*. The panel plated with Bath 4 where the concentration of 3-mercapto-1-propane sulfonate, sodium salt was 5 ppm had a matt deposit as shown in FIG. 1*d*. The $MattCD_{max}$ for this concentration exceeded 80 ASF.

EXAMPLE 2

Figure 2:
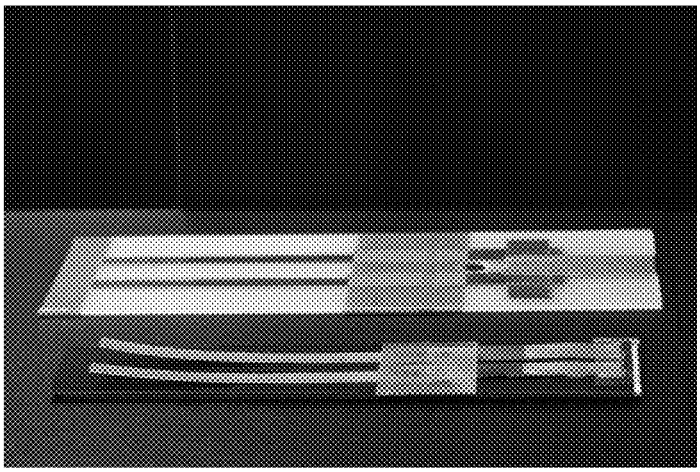
FIG. 2 is a photograph of copper foil test strips on a support and secured with plater's tape before electroplating and removed from the support after electroplating with copper.

Two flexible copper/beryllium foil test strips were coated on one side with a dielectric to enable single sided plating on the uncoated side. The test strips were taped to a support substrate with platers tape as shown in FIG. 2 and placed in a Haring Cell containing an acid copper plating bath having the formulation of Bath 1 in the Table of Example 1. The bath was at room temperature. A copper metal strip was used as an anode. The test foil strips and anode were connected to a rectifier. The test foil strips were copper plated at an average current density of 50 ASF to a deposit thickness of 40-50 μm on the uncoated side of each strip.

After plating was completed the test strips were removed from the Haring Cell, rinsed with water, dried and the platers tape was removed from the test strips. The copper deposit on each test strip was bright. Each test strip showed bowing due to the build-up of internal stress in the copper deposits as shown in FIG. 2.

EXAMPLE 3

Figure 3A:
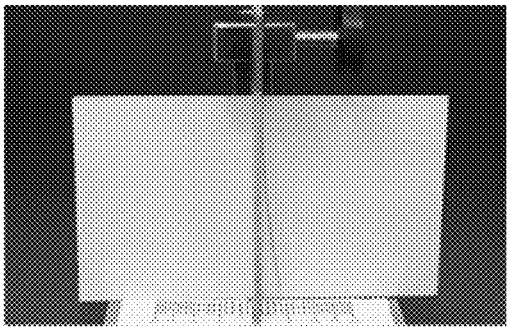
FIG. 3*a* is a photograph of a copper foil test strip showing stress induced deflection.
Figure 3B:
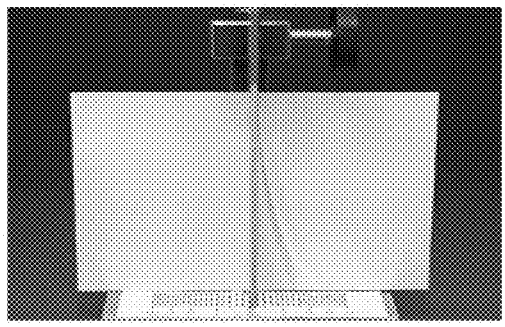
FIG. 3*b* is a photograph of a copper foil test strip showing stress induced deflection after one week.

Two flexible copper/beryllium foil test strips coated on one side with a dielectric were copper plated with the bath and method described in Example 2 above. After plating the test strips and support substrates were removed from the Haring Cell, rinsed with water and dried. The copper deposits on the test strips were bright. The test strips were removed from the support substrates and inserted at one end into screw clamps of a deposit stress analyzer (available from Specialty Testing and Development Co., Jacobus, Pa.). The test strips were at room temperature. Within 4 hours the test strips bowed as shown in FIG. 3*a*. The internal stress of the copper deposit on both strips was determined to be 160 psi. The stress was determined using the equation $S=U/3T\times K$, where S is stress in psi, U is number of increments of deflection on the calibrated scale, T is deposit thickness in inches and K is the test strip calibration constant. After allowing the test strips to age for one week, deflection of the test strips increased as shown in FIG. 3*b*. The stress for each strip was determined to be 450 psi. This was indicative of transformation of the grain structure of the copper deposit due to self annealing.

EXAMPLE 4

The method in Example 3 was repeated except that the test strips were plated with copper from Bath 3 in the Table of Example 1 which included 3 ppm of 3-mercapto-1-propane sulfonate, sodium salt. Copper plating was done in a Haring Cell at room temperature at 50 ASF which was a current density below the MattCDmax of 60 ASF as determined in Example 1. Copper plating was done until a copper deposit of 40-50 μm was deposited on each test strip.

Figures 4A, 4B:
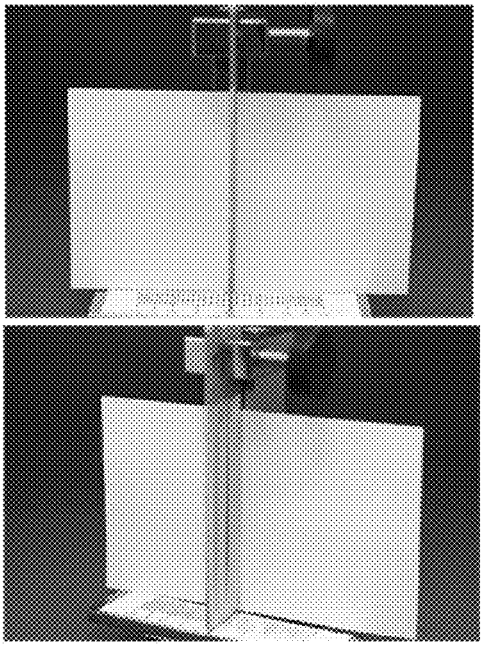
FIG. 4*a-b* is a photograph of a copper foil test strip 24 hours after electroplating with a copper electroplating bath including 4 ppm of 3-mercapto-1-propane sulfonate.
Figures 4C, 4D:
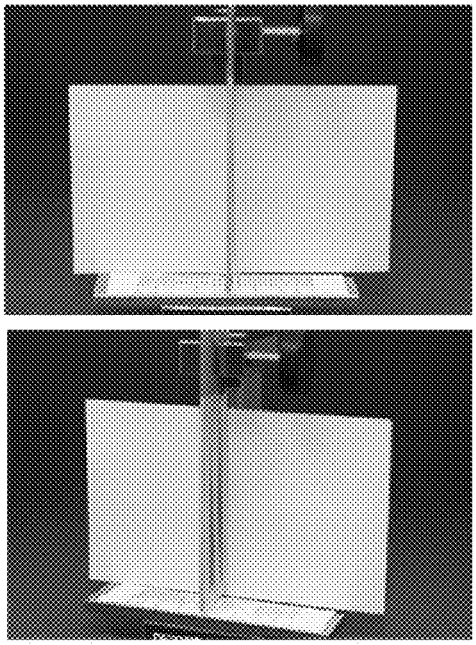
FIG. 4*c-d* is a photograph of a copper foil test strip one month after electroplating with a copper electroplating bath including 4 ppm of 3-mercapto-1-propane sulfonate.

After the test strips were removed from the Haring Cell, they were rinsed with water and dried. The copper deposits were matt. One end of each test strip was then inserted in the screw clamps of the deposit stress analyzers at room temperature. Within 24 hours the test strips did not show any deflection as shown in FIGS. 4*a-b*. The stress for each strip was determined to be 0 psi. After one month at room temperature, very little deflection was observed in either strip as shown in FIGS. 4*c-d*. The stress for each strip was determined to be 30 psi. Bath 3 which included 3 ppm of 3-mercapto-1-propane sulfonate, sodium salt showed reduced internal stress in comparison to Bath 1 which did not include 3 ppm of 3-mercapto-1-propane sulfonate, sodium salt.

EXAMPLE 5

Two monocrystalline silicon wafer substrates were provided which had been coated with a copper seed layer. Each wafer was plated with copper in a plating cell at an average current density of 40 ASF to 40 microns thickness as described in Example 2 except that one of the test substrates was plated from a copper bath which had the components of Bath 3 in Example 1 except that the concentration of 3-mercapto-1-propane sulfonate, sodium salt was increased to 4 ppm. The wafer which was plated in the bath which excluded the 3-mercapto-1-propane sulfonate, sodium salt had a bright copper deposit, while the wafer which was plated with the bath having 3-mercapto-1-propane sulfonate, sodium salt had a matt copper deposit.

Figure 5A:
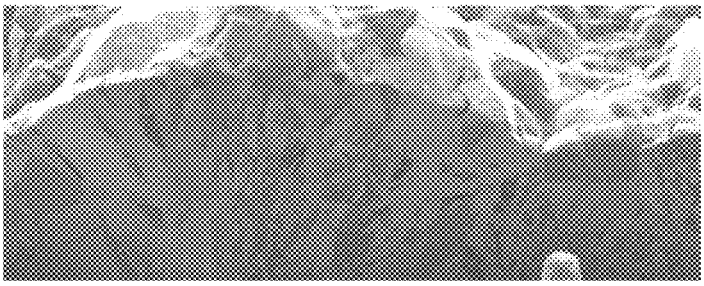
FIG. 5*a* is a SEM at 10,000 power of a cross-sectional view taken shortly after plating of a matt copper deposit electroplated from a copper electroplating bath including 4 ppm of 3-mercapto-1-propane sulfonate.
Figure 5B:
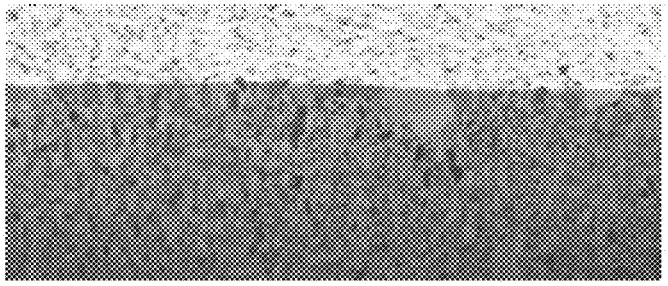
FIG. 5*b* is a SEM at 10,000 power of a cross-sectional view taken shortly after plating of a copper deposit electroplated with a conventional bright copper electroplating bath.

FIB and SEM were used to examine the grain structure of each copper deposit shortly after plating. FIG. 5*a* is a FIB-SEM image of the copper deposited from the bath containing 4 ppm of 3-mercapto-1-propane sulfonate, sodium salt. The deposit had both an angular crystalline surface appearance and a large grain size characteristic of a matt copper deposit. In contrast, FIG. 5*b* is a FIB-SEM of the copper deposit from the bath which did not contain 3-mercapto-1-propane sulfonate, sodium salt. The surface was smooth and the grain structure smaller, finer than that of the matt deposit and typical of an as plated conventional bright copper deposit.

Figures 6A, 6B, 6C, 6D:
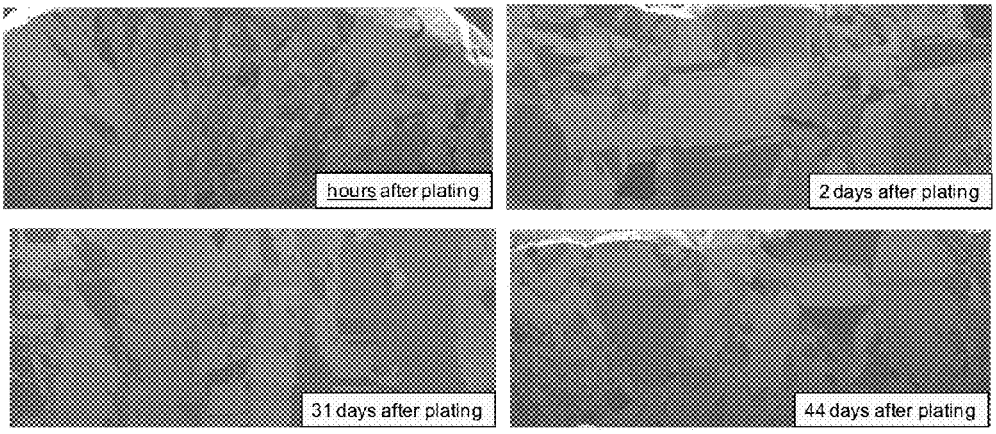
FIG. 6*a* is a SEM at 10,000 power of a cross-sectional view of the grain structure of a matt copper deposit electroplated from a copper electroplating bath including 4 ppm of 3-mercapto-1-propane sulfonate 2-6 hours after electroplating.
FIG. 6*b* is a SEM at 10,000 power of a cross-sectional view of the grain structure of a matt copper deposit electroplated from a copper electroplating bath including 4 ppm of 3-mercapto-1-propane sulfonate 2 days after electroplating.
FIG. 6*c* is a SEM at 10,000 power of a cross-sectional view of the grain structure of a matt copper deposit electroplated from a copper electroplating bath including 4 ppm of 3-mercapto-1-propane sulfonate thirty-one days after electroplating.
FIG. 6*d* is a SEM at 10,000 power of a cross-sectional view of the grain structure of a matt copper deposit electroplated from a copper electroplating bath including 4 ppm of 3-mercapto-1-propane sulfonate 44 days after electroplating.

FIB and SEM were used to examine the grain structures of the copper from other similarly plated substrates as they aged over time. Plating was conducted at an average current density of 40 ASF to a thickness of 40 microns as described in Example 2 except that one of the test substrates was plated with copper from a copper bath which had the components of Bath 3 in Example 1 except that the concentration of 3-mercapto-1-propane sulfonate, sodium salt was increased to 4 ppm. The FIGS. 6*a*-6*d* were taken from different areas of the plated test substrate. FIG. 6*a* shows the large grain structure of the matt deposit after a few hours of plating. FIG. 6*b* shows the grain structure after 2 days. FIG. 6*c* shows the grain structure after thirty-one days and FIG. 6*d* shows the grain structure after forty-four days. The grain structure of the matt deposit did not change substantially over a forty-four day period. The stability of the grain structure accounted for the consistently low internal stress over time of copper deposits plated with 3-mercapto-1-propane sulfonate, sodium salt bath additive at the specified concentration and current density.

Figure 6E:
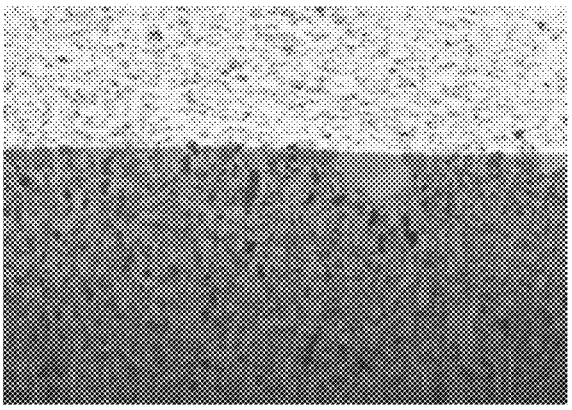
FIG. 6*e* is a SEM at 10,000 power of a cross-sectional view of the grain structure of a conventional bright copper deposit 2-6 hours after plating.
Figure 6F:
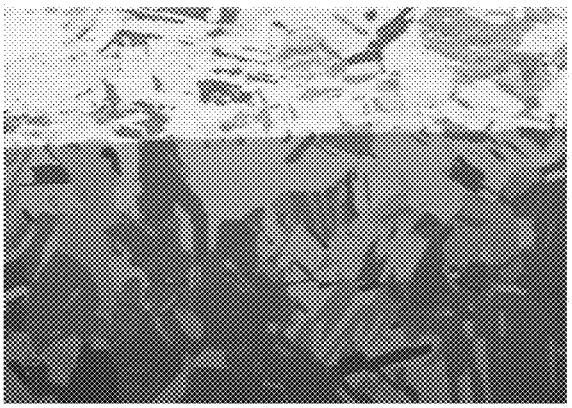
FIG. 6*f* is a SEM at 10,000 power of a cross-sectional view of the grain structure of a conventional bright copper deposit after two days.
Figure 6G:
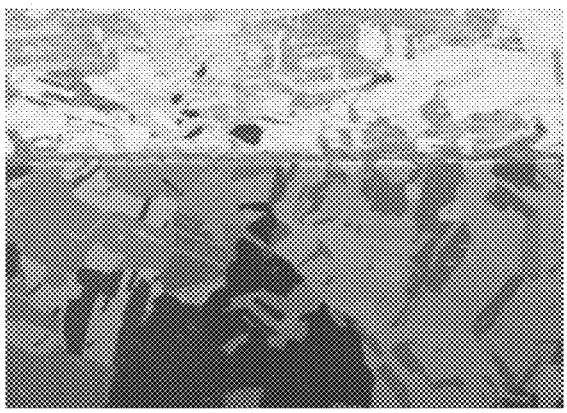
FIG. 6*g* is a SEM at 10,000 power of a cross-sectional view of the grain structure of a conventional bright copper deposit after two weeks.

FIG. 6*e* shows the smaller grain structure of the bright copper deposit after a few hours after plating at room temperature. FIG. 6*f* shows the same deposit from a different area of the substrate after two days at room temperature. Dramatic structural change occurred. The grain size of the deposit increased. FIG. 6*g* shows the same deposit from a different area of the substrate after two weeks at room temperature. The grain size is similar to that after two days. This change in the grain size indicates that the bight copper deposit self annealed with time concurrent with a substantial increase in internal stress.

What is claimed is:

1. A method comprising:

a) contacting a Hull Cell metal test panel with a composition comprising one or more sources of copper ions, one or more suppressors and an accelerator at a given concentration in a range of 1 ppm and greater;

b) applying a current to the Hull Cell metal test panel for a given period of time over different current densities to electroplate copper on the Hull Cell metal test panel;

c) determining MattCDmax by correlating a current density where the electroplated copper deposit transitions from matt to bright at the given concentration of the accelerator; and d) electroplating copper with a matt appearance from the composition at the MattCDmax or at a lower current density below the MattCDmax on a substrate at the given concentration of the accelerator or optionally at a greater accelerator concentration than the given accelerator concentration.

2. The method of claim 1, wherein the accelerator is chosen from one or more of 3-mercaptopropane-1-sulfonic acid, ethylenedithiodipropyl sulfonic acid, bis-(ω-sulfobutyl)-disulfide, methyl-(ω-sulfopropyl)-disulfide, N,N-dimethyldithiocarbamic acid (3-sulfopropyl) ester, (O-ethyldithiocarbonato)-S-(3-sulfopropyl)-ester, 3-[(amino-iminomethyl)-thiol]-1-propanesulfonic acid, 3-(2-benzylthiazolylthio)-1-propanesulfonic acid, bis-(sulfopropyl)-disulfide and alkali metal salts thereof.

3. The method of claim 1, wherein the one or more sources of copper ions are chosen from copper sulfate and copper alkane sulfonates.

4. The method of claim 1, wherein the suppressors are chosen from one or more of polyoxyalkylene glycol, carboxymethylcellulose, nonylphenolpolyglycol ether, octandiolbis-(polyalkylene glycolether), octanolpolyalkylene glycolether, oleic acidpolyglycol ester, polyethylenepropylene glycol, polyethylene glycol, polyethylene glycoldimethylether, polyoxypropylene glycol, polypropylene glycol, polyvinylalcohol, stearic acidpolyglycol ester and stearyl alcoholpolyglycol ether.

5. The method of claim 1, wherein the accelerator concentration ranges from 2 ppm and greater.

6. The method of claim 5, wherein the accelerator concentration ranges from 3 ppm to 500 ppm.

* * * * *